US011433665B2

(12) United States Patent
Hiruma

(10) Patent No.: US 11,433,665 B2
(45) Date of Patent: Sep. 6, 2022

(54) PRINTING APPARATUS

(71) Applicant: SEIKO EPSON CORPORATION, Tokyo (JP)

(72) Inventor: Daisuke Hiruma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/203,158

(22) Filed: Mar. 16, 2021

(65) Prior Publication Data

US 2021/0291519 A1 Sep. 23, 2021

(30) Foreign Application Priority Data

Mar. 19, 2020 (JP) ..... JP2020-048800

(51) Int. Cl.
*B41J 11/02* (2006.01)
*B41J 2/125* (2006.01)
*B41J 29/19* (2006.01)

(52) U.S. Cl.
CPC ..... *B41J 2/125* (2013.01); *B41J 29/19* (2013.01)

(58) Field of Classification Search
CPC ..... B41J 11/02; B41J 11/003; B41J 11/009; B41J 11/0095; B41J 2203/01; B41J 2203/011; B41J 29/38
See application file for complete search history.

(56) References Cited

U.S. PATENT DOCUMENTS

2004/0100090 A1* 5/2004 Davis ..... B42D 25/373 283/91
2004/0183850 A1* 9/2004 Takeuchi ..... B41J 11/06 347/19
2007/0138418 A1 6/2007 Sasa

FOREIGN PATENT DOCUMENTS

JP 2004-255867 A 9/2004
JP 2005-212205 A 8/2005
JP 2007-168125 A 7/2007

* cited by examiner

*Primary Examiner* — Scott A Richmond
(74) *Attorney, Agent, or Firm* — Workman Nydegger

(57) ABSTRACT

A printing apparatus includes a transport unit configured to transport a printing medium, a platen that includes a first support surface supporting the printing medium, a light-emitting unit configured to emit detection light toward a transport path of the printing medium, and a light-receiving unit provided adjacently to the light-emitting unit and configured to detect reflected light of the detection light, wherein a recessed portion is provided in the platen, the recessed portion including a primary reflection surface receiving the detection light and a secondary reflection surface receiving the detection light reflected by the primary reflection surface, and the first support surface and the secondary reflection surface overlap in an optical axis direction of the detection light.

9 Claims, 6 Drawing Sheets

PRINTING APPARATUS

The present application is based on, and claims priority from JP Application Serial Number 2020-048800, filed Mar. 19, 2020, the disclosure of which is hereby incorporated by reference herein in its entirety.

BACKGROUND

1. Technical Field

The disclosure relates to a printing apparatus.

2. Related Art

In recent years, a printing apparatus is known that detects a printing medium by irradiating a position where the printing medium is transported with the detection light and receiving the reflected light. For example, an inkjet recording apparatus described in JP-A-2004-255867 includes a reflective sensor having a light emitting element and a photoreceptor element. The inkjet recording apparatus detects the presence or absence of a printing medium by receiving light emitted toward the a flat platen with the photoreceptor element.

In the above-described recent configuration, in a case where the reflected light reflected by the platen, etc. in the absence of the printing medium is incident on the photoreceptor element or a light-receiving unit, the detection accuracy will be reduced. As a countermeasure against such a phenomenon, an inkjet recording apparatus described in JP-A-2004-255867 has a flat platen subjected to anti-reflective treatment by sandblasting. However, in order to sufficiently reduce the reflected light incident on the photoreceptor element or the light-receiving unit in the absence of the printing medium, processing with a large cost and man-hours, such as provision of a wide range of anti-reflective treatments, is required. Furthermore, depending on the shape of the platen, it may be difficult to perform the anti-reflective treatment.

SUMMARY

An aspect for solving the above-described problem is a printing apparatus including a transport unit configured to transport a printing medium, a platen that includes a support surface supporting the printing medium, a light-emitting unit configured to emit detection light toward a transport path of the printing medium, and a light-receiving unit provided adjacently to the light-emitting unit and configured to detect reflected light of the detection light, wherein a recessed portion is provided in the platen, the recessed portion including a primary reflection surface receiving the detection light and a secondary reflection surface receiving the detection light reflected by the primary reflection surface, and the support surface and the secondary reflection surface overlap in an optical axis direction of the detection light.

In the printing apparatus described above, the secondary reflection surface may be formed parallel to the primary reflection surface.

In the printing apparatus described above, the secondary reflection surface may be a surface that diffuses and reflects incident light.

In the printing apparatus described above, the secondary reflection surface may be a surface rougher than the primary reflection surface.

The printing apparatus described above may be configured wherein the support surface is located upstream from the recessed portion in a transport direction of the printing medium, the platen includes a downstream support surface located downstream from the recessed portion in the transport direction of the printing medium, the downstream support surface supporting the printing medium, and the primary reflection surface is a surface continuous with the downstream support surface, the primary reflection surface facing upstream in the transport direction of the printing medium.

The printing apparatus described above may include a carriage configured to perform reciprocating scanning in a scanning direction that intersects with the transport direction of the printing medium, and a print head mounted on the carriage, wherein the light-emitting unit and the light-receiving unit may be mounted on the carriage, and the recessed portion may extend along the scanning direction.

DESCRIPTION OF EXEMPLARY EMBODIMENTS

Hereinafter, an embodiment of the present disclosure will be described with reference to the accompanying drawings.

Figure 1:
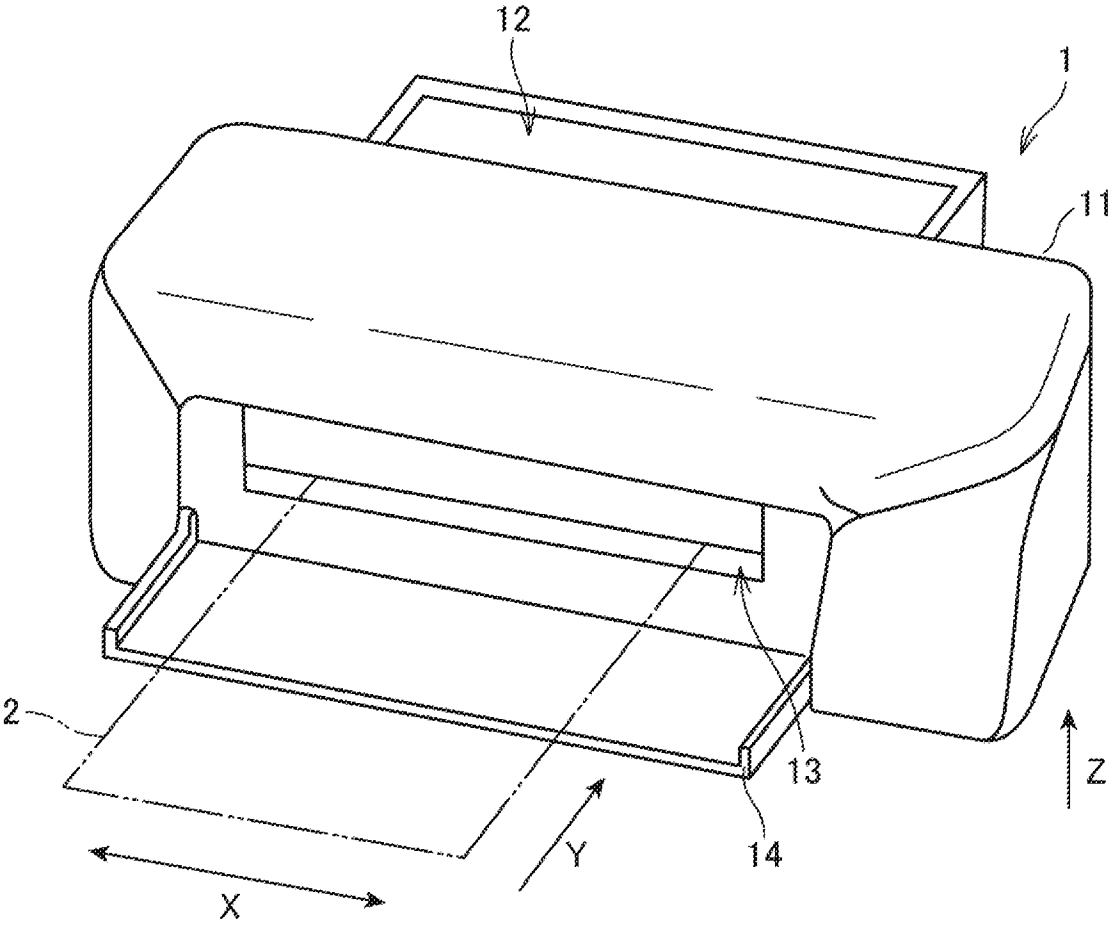
FIG. 1 is an external perspective view of a printing apparatus.

FIG. 1 is an external perspective view of a printing apparatus 1.

The printing apparatus 1 forms an image on a printing surface of a printing medium 2 by a printing head 31, which will be described later. The printing apparatus 1 can use various sheets made of paper or synthetic resin as the printing medium 2. For example, dedicated paper for inkjet recording such as plain paper, high-quality paper, and gloss paper, can be used. The printing medium 2 may be a cut sheet that is cut to a regular size, or may be a continuous sheet such as roll paper. The method by which the printing apparatus 1 forms an image is not limited thereto. The present embodiment describes, as an example, an ink jet-type printing apparatus 1 that forms an image by attaching ink to the printing medium 2.

Figure 2:
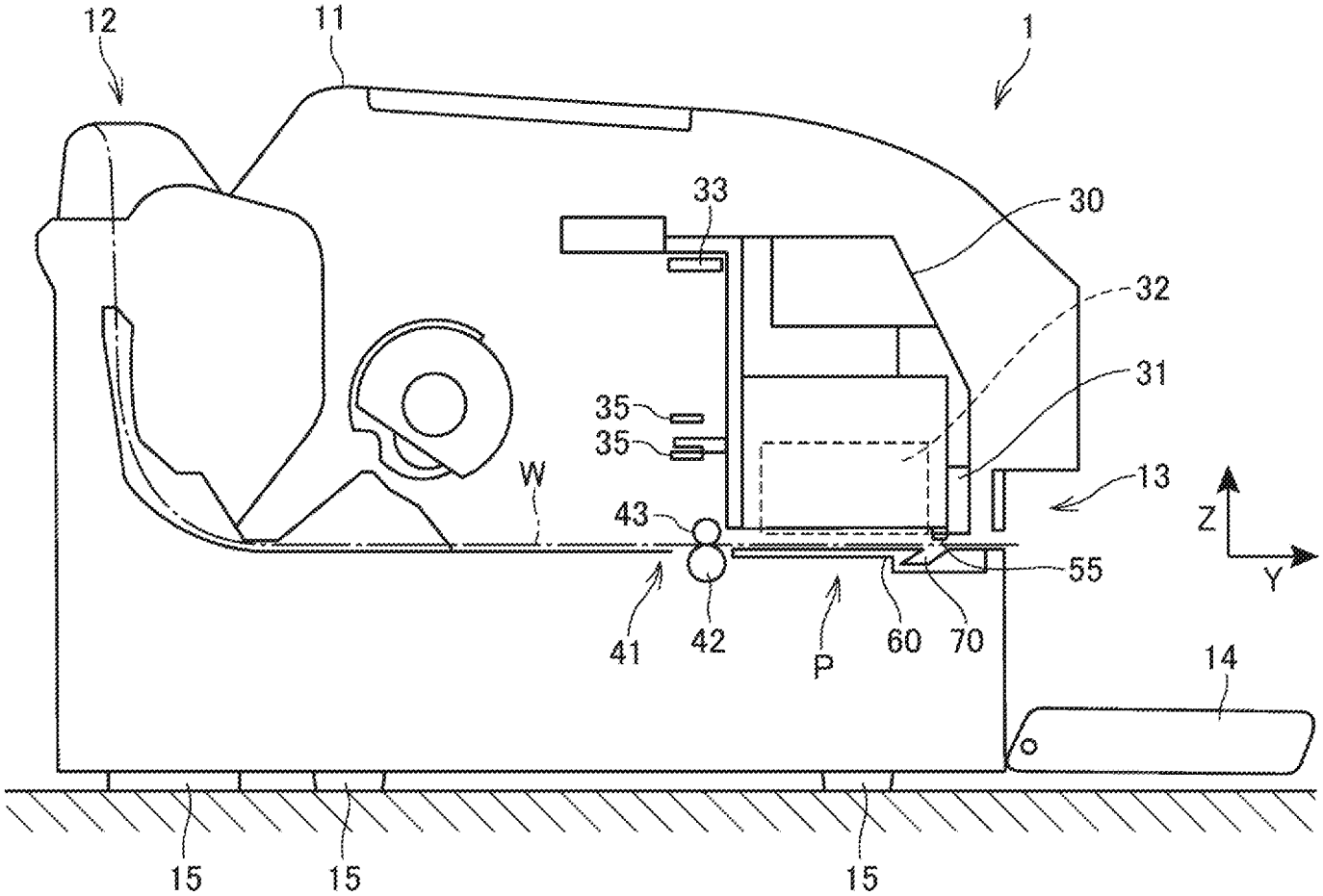
FIG. 2 is a side cross-sectional view of the printing apparatus.

An insertion unit 12 is formed in the back portion of a main body 11 of the printing apparatus 1. The printing medium 2 is inserted into the insertion unit 12. After printing, the printed medium 2 is ejected from a front opening 13 of the main body 11. An opening panel 14 covering the front opening 13 is disposed on the front surface of the main body 11 so as to be openable and closable. As illustrated in FIG. 2, a plurality of legs 15 contacting the installation surface of the printing apparatus 1 are provided on the bottom surface of the main body 11.

In FIG. 1 and the drawings described below, a transport direction of the printing medium 2 is indicated by the reference sign Y. The transport direction Y corresponds to the front of the main body 11. The reference sign X is a direction that intersects with the transport direction Y and indicates a width direction of the printing medium 2. Further, the direction X is a width direction of the main body 11 of the printing apparatus 1, and coincides with a scanning direction of the carriage 30, which will be described later. Therefore, the direction X is referred to as the scanning direction. In the drawings, a height direction of the main body 11 is indicated by the reference sign Z. The reference sign Z corresponds to an upper direction in the main body 11.

Figure 3:
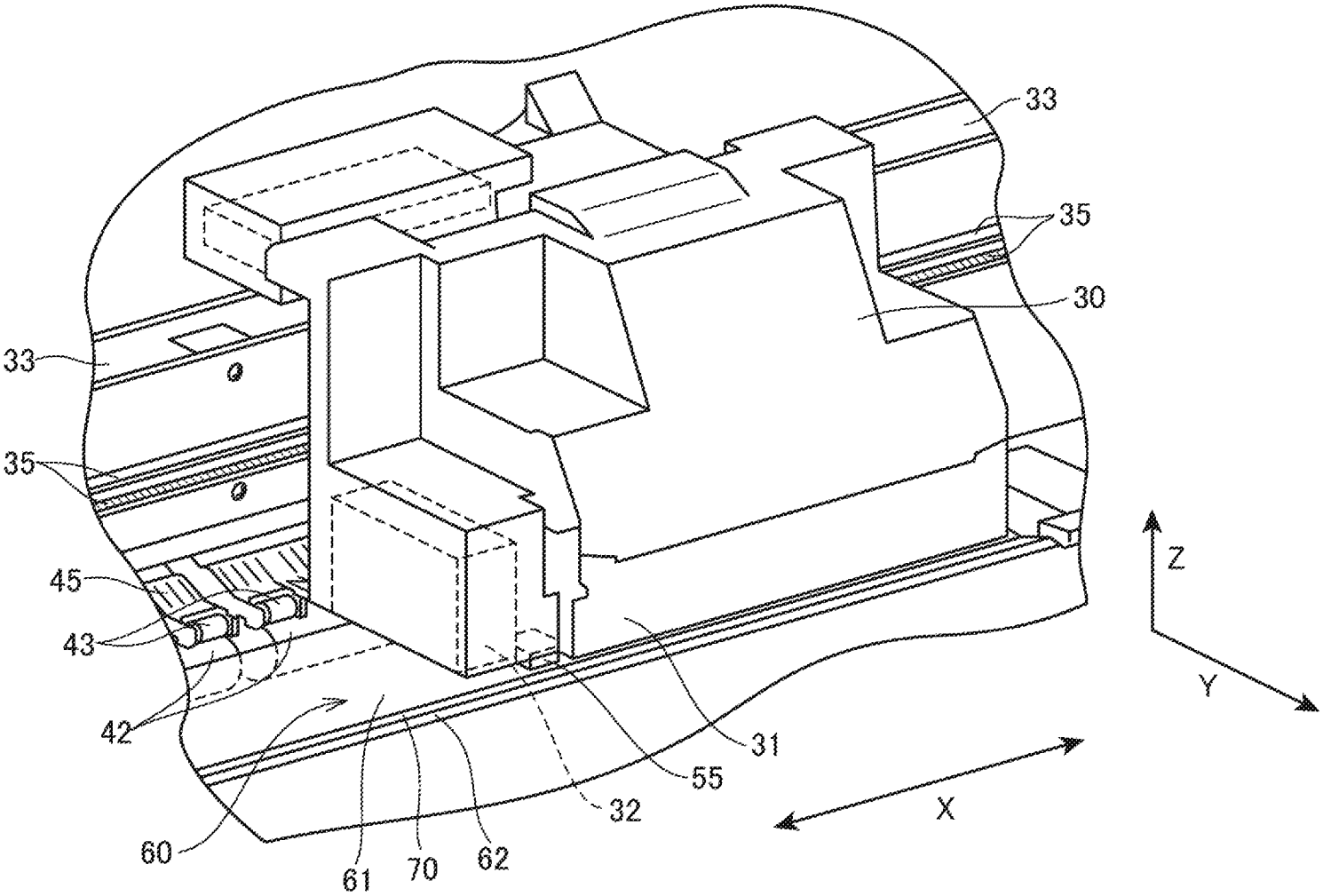
FIG. 3 is a perspective view of a main portion of the printing apparatus.

FIG. 2 is a side cross-sectional view of the printing apparatus 1, illustrating a main portion of an internal structure of the main body 11. FIG. 3 is a perspective view of a main portion of the printing apparatus 1, illustrating a configuration of the main portion including a carriage 30 and a platen 60.

The printing medium 2 is inserted from the insertion unit 12 provided at the back portion of the main body 11, and is transported inside the main body 11 along a transport path W indicated by the reference sign W in the drawing. A first transport unit 41 transporting the printing medium 2 is disposed in the main body 11 along the transport path W. The first transport unit 41 includes a driving roller 42 located below the transport path W and a driven roller 43 located above the transport path W facing the driving roller 42. The drive roller 42 is rotated by the power of a transport motor, which is not illustrated. The driven roller 43 is rotatably supported by a roller holder 45 illustrated in FIG. 3 and biased toward the driving roller 42. The first transport unit 41 nips the printing medium 2 by the driving roller 42 and the driven roller 43, and transports the printing medium 2 in the transport direction Y by the driving force of the driving roller 42. The first transport unit 41 corresponds to an example of a "transport unit". the printing apparatus 1 may include, in addition to the first transport unit 41, a mechanism for transporting the printing medium 2.

The main body 11 includes a carriage guide rail 33 extending along the scanning direction X. The carriage 30 is engaged with the carriage guide rail 33. An endless belt 35 arranged along the carriage guide rail 33 is coupled to the carriage 30. The endless belt 35 is passed over a pair of pulleys that are rotated by the power of a carriage drive motor, which is not illustrated, to move the carriage 30 in the scanning direction X by the rotational force of the pulleys. The direction of rotation of the carriage drive motor is switchable between the positive direction and the reverse direction, so that the carriage 30 is configured to perform reciprocating scanning along the scanning direction X.

Mounted on the carriage 30 are a print head 31 that discharges ink facing the transport path W and an ink cartridge 32 that supplies ink to the print head 31. The printing apparatus 1 performs printing on the printing medium 2 by discharging ink toward the printing medium 2 with the print head 31 while scanning the carriage 30 in the scanning direction X. An image is printed on the printing medium 2 at a printing position p in which the printing medium 2 faces a nozzle of the print head 31.

The carriage 30 includes a medium sensor 55 that detects the printing medium 2. The medium sensor 55 is a reflection-type optical sensor including a light-emitting unit 56 configured to emit detection light, and a light-receiving unit 57 configured to receive light and detect the detection light. The medium sensor 55 is arranged side by side with the print head 31 on the bottom surface of the carriage 30 so as to face the transport direction Y.

The light-emitting unit 56 has a light source such as an LED, and irradiates the detection light toward the transport path W. The optical axis of the detection light emitted by the light-emitting unit 56 faces downward, and is substantially orthogonal to the transport path W in the present embodiment. Here, the LED is an abbreviation for Light Emitting Diode.

The light-receiving unit 57 includes a photoreceptor element such as a photo transistor or a photodiode, and receives light from the transport path W. The light-receiving unit 57 is disposed so that the direction with high detection sensitivity faces downward, i.e., toward the transport path W.

The platen 60 is provided below the carriage 30.

The platen 60 is arranged facing the carriage 30 via the transport path W. The platen 60 supports the printing medium 2, to which the transport path W is transported, from below. As illustrated in FIG. 3, the platen 60 is provided along the scanning direction X of the carriage 30.

Figure 4:
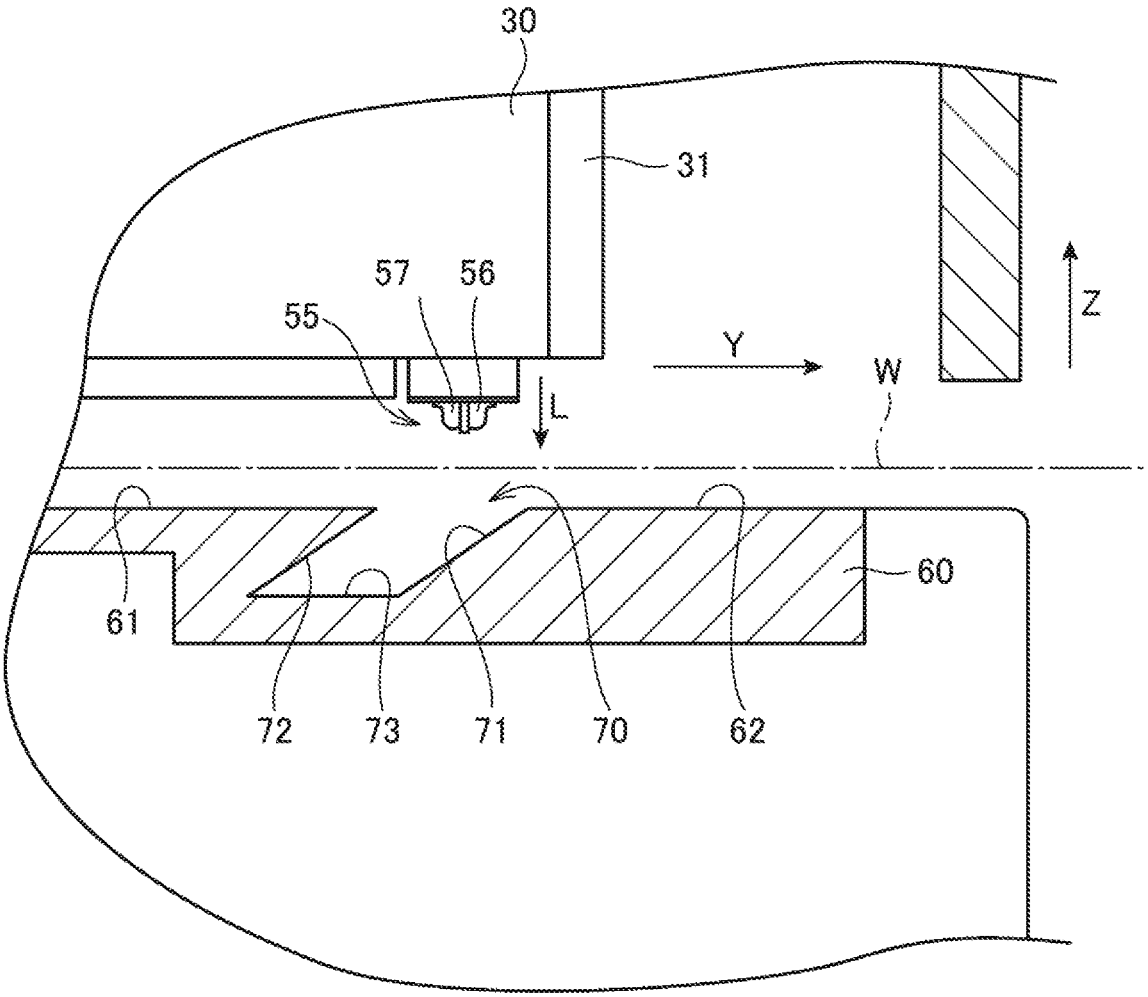
FIG. 4 is an enlarged side view of a main portion of the printing apparatus.

FIG. 4 is an enlarged side view of a main portion of the printing apparatus 1, particularly illustrating a configuration of the medium sensor 55 and the platen 60.

The platen 60 includes a flat surface supporting the printing medium 2 and a recessed portion 70 that faces the medium sensor 55. The flat surface of the platen 60 includes a first support surface 61 located upstream from the recessed portion 70 in the transport direction Y, and a second support surface 62 located downstream from the recessed portion 70. The first support surface 61 corresponds to an example of a support surface, while the second support surface 62 corresponds to an example of a downstream support surface.

The recessed portion 70 is provided along the scanning direction X. In a range in which the medium sensor 55 moves in the scanning direction X, at least in a range in which the printing medium 2 is transported, the medium sensor 55 faces the recessed portion 70.

A primary reflection surface 71, a secondary reflection surface 72, and a bottom surface 73 are formed in the recessed portion 70. Each of these surfaces is formed so as to extend in the scanning direction X. The primary reflection surface 71 receives and reflects the detection light irradiated from the light-emitting unit 56. The secondary reflection surface 72 is a surface that receives the detection light reflected by the primary reflection surface 71, i.e., primary reflected light. The bottom surface 73 is a surface that connects the primary reflection surface 71 to the secondary reflection surface 72. The bottom surface 73 may not be a planar surface.

The primary reflection surface 71 is inclined with respect to the first support surface 61 and the second support surface 62, and in particular, is inclined so as to face the upstream in the transport direction Y. In other words, the primary reflection surface 71 is formed so that the height of the primary reflection surface 71 approaches the second support surface 62 toward the downstream in the transport direction Y.

In a case where the printing medium 2 is transported along the transport path W, a leading end of the printing medium 2 may penetrate the recessed portion 70. In such a case, since the primary reflection surface 71 is a slope facing the upstream in the transport direction Y, the printing medium 2 is guided to the transport path W along the primary reflection surface 71. Therefore, even when the leading end of the printing medium 2 penetrates the recessed portion 70, transport problems such as paper clogging, etc. can be avoided.

In the transport path W, in a case where the printing medium 2 is present at a position facing the medium sensor 55, the detection light emitted by the light-emitting unit 56 is reflected by the surface of the printing medium 2, and then the reflected light is detected by the light-receiving unit 57. In contrast, in a case where the printing medium 2 is not present at a position facing the medium sensor 55, the detection light emitted by the light-emitting unit 56 enters the recessed portion 70, so that the amount of light detected by the light-receiving unit 57 is less than the case where the printing medium 2 is present. The printing apparatus 1 determines the presence or absence of the printing medium 2 at a position facing the medium sensor 55 on the basis of a difference in the amount of light detected by the light-receiving unit 57. As a result, the position of the side end portion of the printing medium 2 in the scanning direction X can be identified. In addition, the leading end and the trailing end of the printing medium 2 in the transport direction Y can be detected.

Figure 5:
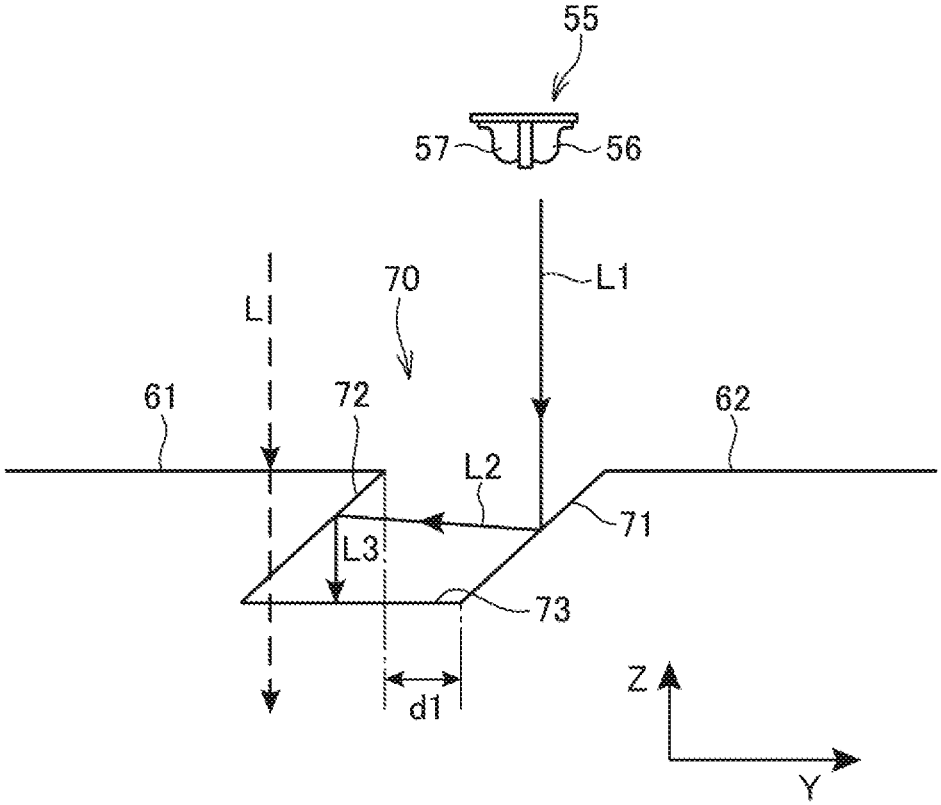
FIG. 5 is a schematic diagram illustrating a reflection path of detection light of a medium sensor.

FIG. 5 is a schematic diagram illustrating a reflection path of the detection light of the medium sensor 55.

In FIG. 5, the optical axis of the detection light emitted by the light-emitting unit 56 is indicated by the reference sign L1. A direction parallel to the optical axis L1 is referred to as the optical axis direction L. The detection light emitted by the light-emitting unit 56 includes a component that diffuses outward from the optical axis L1, where the optical axis L1 corresponds to the center of the detection light.

The detection light emitted by the light-emitting unit 56 is irradiated to the primary reflection surface 71. Primary reflected light L2 is reflected by the primary reflection surface 71 to travel inside the recessed portion 70 in accordance with the inclination of the primary reflection surface 71. In the configuration illustrated in FIG. 5, the primary reflected light L2 is irradiated to the secondary reflection surface 72. Secondary reflected light L3 is reflected by the secondary reflection surface 72 to further travel into the recessed portion 70, so as to reflect, for example, on the bottom surface 73.

In the present configuration, the majority of the primary reflected light L2 reflected by the primary reflection surface 71 does not travel in a direction toward the outside of the recessed portion 70, while being directed toward the secondary reflection surface 72. In addition, since the first support surface 61 and the secondary reflection surface 72 are configured to overlap in the optical axis direction L of the detection light, when the primary reflected light L2 is reflected by the secondary reflection surface 72, the majority of the secondary reflected light L3 is directed toward the primary reflected light L2 and the bottom surface 73. Out of the secondary reflected light L3, the amount of light exiting to the outside of the recessed portion 70 and received by the light-receiving unit 57 is significantly smaller than, for example, the amount of light when the printing medium 2 is at a position facing the medium sensor 55 in the transport path W. As a result, when the printing medium 2 is detected by the medium sensor 55, the effects of the reflected light reflected by the platen 60 can be suppressed. Therefore, the amount of light received by the light-receiving unit 57 has a distinctive difference between the case where the printing medium 2 is present at a position facing the medium sensor 55 and the case where the printing medium 2 is not present, so that the print medium 2 can be detected with high accuracy by the medium sensor 55. Moreover, false detection of the medium sensor 55 can be prevented or suppressed.

Furthermore, some of the primary reflected light L2 may be irradiated outside the recessed portion 70. However, since the primary reflection surface 71 is a inclined surface facing the transport direction Y, the component of the primary reflected light L2 irradiated outside the recessed portion 70 and received by the light-receiving unit 57 is significantly less than the detection light. Accordingly, the false detection of the medium sensor 55 can be more effectively prevented or suppressed.

Additionally, the secondary reflection surface 72 is a surface that is formed by a flat surface that faces diagonally downward and inclined so as to extend from downward to upward toward the downstream in the transport direction Y. The secondary reflection surface 72 overlaps with the first support surface 61 in the optical axis direction L. Thus, out of the secondary reflected light L3 reflected by the secondary reflection surface 72, the component directly received by the light-receiving unit 57 is significantly smaller than the reflected light received by the light-receiving unit 57 when the printing medium 2 is at a position facing the medium sensor 55 in the transport path W, for example. Accordingly, the false detection of the medium sensor 55 can be more effectively prevented or suppressed.

Here, the secondary reflection surface 72 may be a surface rougher than the primary reflection surface 71. For example, the surface may be a embossed surface, a sandblasted satin surface, a sandy surface, a hair line-processed surface, etc. In this case, the primary reflected light L2 is diffused into a wide range when being reflected by the secondary reflection surface 72. Therefore, out of the secondary reflected light L3, the component directly received by the light-receiving unit 57 can be greatly reduced.

The secondary reflection surface 72 may be a surface having a lower reflectivity than the primary reflection surface 71. For example, the secondary reflection surface 72 may be coated with a paint having a low reflectivity. In this case as well, out of the secondary reflected light L3, the component directly received by the light-receiving unit 57 can be greatly reduced.

In the configuration example illustrated in FIG. 5, the primary reflection surface 71 and the secondary reflection surface 72 are separated by a distance dl in the transport direction Y, while the present disclosure is not limited to such a configuration. For example, the primary reflection surface 71 and the secondary reflection surface 72 may be configured to be more close in the transport direction Y. Such a configuration is illustrated as a modification.

Figure 6:
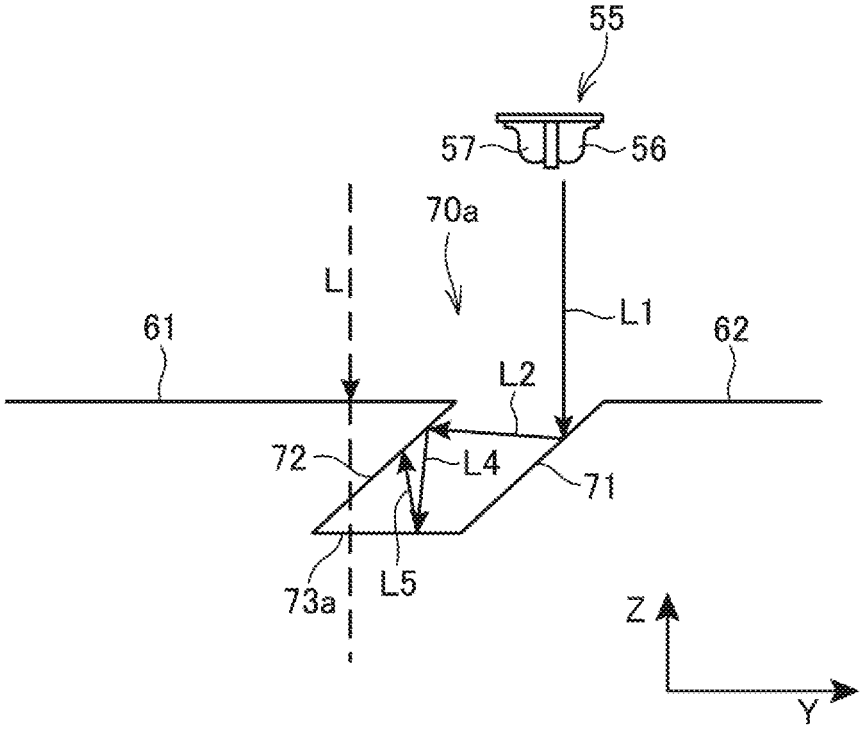
FIG. 6 is a schematic view illustrating a reflection path of detection light in a modification.

FIG. 6 is a schematic view illustrating a reflection path of the detection light in the modification, illustrating a recessed portion 70*a* provided on the platen 60 instead of the recessed portion 70.

In the recessed portion 70*a*, the primary reflection surface 71 and the secondary reflection surface 72 are closer together in the transport direction Y. In particular, the primary reflection surface 71 and the secondary reflection surface 72 overlap or are located very close each other in the optical axis direction L. As such, a bottom surface 73*a* formed between the primary reflection surface 71 and the secondary reflection surface 72 has a smaller size in the transport direction Y than the bottom surface 73 illustrated in FIG. 5.

In the recessed portion 70*a*, the primary reflected light L2 is reflected by the secondary reflection surface 72, so that the majority of the secondary reflected light L4 is reflected within the recessed portion 70*a*. Therefore, out of the secondary reflected light L4, the amount of light of the component traveling from the secondary reflection surface 72 directly toward the outside of the recessed portion 70*a* is even smaller than that illustrated in FIG. 5. In addition, out of the tertiary reflected light L5 in which the secondary reflected light L4 is reflected to the bottom surface 73*a*, the amount of light of the component traveling directly toward the outside of the recessed portion 70*a* is even smaller.

Accordingly, according to the configuration illustrated in FIG. 6, when the printing medium 2 is detected by the medium sensor 55, the effects of the reflected light reflected by the platen 60 can be more effectively suppressed. Accordingly, the false detection of the medium sensor 55 can be prevented or suppressed.

With the configuration illustrated in FIG. 5, the size of the recessed portion 70 in the transport direction Y is large, therefore, the required level for machining accuracy when manufacturing the platen 60 is low. This has advantages such as increased design freedom and increased production efficiency. On the other hand, the configuration illustrated in FIG. 6 has the advantage that miniaturization of the printing apparatus 1 can be expected due to the size of the recessed portion 70*a* in the transport direction Y being small.

As described above, the printing apparatus 1 according to the embodiment to which the present disclosure is applied includes the first transport unit 41 corresponding to an example of the transport unit configured to transport the printing medium 2, and the platen 60 having the first support surface 61 that supports the printing medium 2. The printing apparatus 1 includes the light-emitting unit 56 configured to irradiate the detection light toward the transport path W of the printing medium 2, and the light-receiving unit 57 provided adjacently to the light-emitting unit 56 and configured to detect the reflected light of the detection light. In the printing apparatus 1, the recessed portion 70 is provided in the platen 60, wherein the recessed portion 70 has the primary reflection surface 71 that receives the detection light and the secondary reflection surface 72 that receives the detection light reflected by the primary reflection surface 71. In the printing apparatus 1, the first support surface 61 and the secondary reflection surface 72 overlap in the optical axis direction L of the detection light.

According to the present configuration, the secondary reflected light L3 reflected by the secondary reflection surface 72 is reflected away from the light-receiving unit 57. Therefore, out of the secondary reflected light L3, the amount of light received by the light-receiving unit 57 can be effectively suppressed. As a result, when the printing medium 2 is detected by the medium sensor 55, the effects of the reflected light reflected by the platen 60 can be suppressed. Therefore, the amount of light received by the light-receiving unit 57 has a distinctive difference between the case where the printing medium 2 is present at a position facing the medium sensor 55 and the case where the printing medium 2 is not present, so that the print medium 2 can be detected with high accuracy by the medium sensor 55. Moreover, the false detection of the medium sensor 55 can be prevented or suppressed.

In the printing apparatus 1, the secondary reflection surface 72 is formed parallel to the primary reflection surface 71. According to the present configuration, the majority of the primary reflected light L2 can be directed toward the secondary reflection surface 72. Therefore, out of the primary reflected light L2, the light directed toward the outside of the recessed portion 70 can be effectively suppressed. This allows for suppressing the effects of reflected light in the platen 60 on the medium sensor 55.

In the printing apparatus 1, the secondary reflection surface 72 may be a surface that diffuses and reflects incident light. In this case, out of the secondary reflected light L3, the component directly received by the light-receiving unit 57 can be more effectively suppressed by diffusing the secondary reflected light L3.

In the printing apparatus 1, the secondary reflection surface 72 may be a surface rougher than the primary reflection surface 71. For example, the surface may be a embossed surface, a sandblasted satin surface, a sandy surface, a hair line-processed surface, etc. In this case, the primary reflected light L2 is diffused into a wide range when being reflected by the secondary reflection surface 72. Therefore, out of the secondary reflected light L3, the component that is directly received by the light-receiving unit 57 can be further reduced.

In the printing apparatus 1, the platen 60 has the second support surface 62 that supports the printing medium 2. The primary reflection surface 71 is connected to the second support surface 62 and is formed so as to approach the second support surface 62 downstream in the transport direction Y of the printing medium 2. According to the present configuration, penetration of the printing medium 2 into the recessed portion 70 can be prevented, and further the effects of the recessed portion 70 formed in the platen 60 on the transport of the printing medium 2 can be suppressed.

The printing apparatus 1 includes the carriage 30 that is configured to perform reciprocating scanning in the scanning direction X that intersects with the transport direction Y of the printing medium 2, and the print head 31 mounted on the carriage 30. The light-emitting unit 56 and the light-receiving unit 57 are mounted on the carriage 30. The recessed portion 70 extends along the scanning direction X. According to the present configuration, in the printing apparatus 1 including the carriage 30 that is configured to perform reciprocating scanning in the scanning direction X, the printing medium 2 can be detected with high accuracy by the medium sensor 55. Moreover, the false detection of the medium sensor 55 can be prevented or suppressed.

Note that the above embodiment describes a specific example in which the present disclosure is applied, and the present disclosure is not limited thereto.

For example, in the embodiment described above, the configuration has been illustrated in which the print head 31 is mounted on the carriage 30 that is configured to perform reciprocating scanning in the scanning direction X, however, the present disclosure is not limited thereto. For example, the present disclosure may be applied to a line-head type printing apparatus capable of linearly extending nozzles and discharging ink from each nozzle to a region where the printing medium 2 is transported in the scanning direction X. In this case, with a configuration in which the medium sensor 55 is arranged in accordance with the position of the line-head with the recessed portion 70 of the platen 60 being provided at the position corresponding to the medium sensor 55, the same effects as in the above embodiment can be achieved.

Furthermore, in the embodiment described above, the case where the present disclosure is applied to the inkjet printing apparatus 1 has been described, which is merely an example. The present disclosure can be applied to various types of printing apparatuses such as dot impact type, sublimation type, heat transfer type, etc.

In addition, the present disclosure can be applied to a composite machine having a copying function, or a printing apparatus incorporated into another device. Furthermore, other detailed configurations in the above-described embodiments, needless to exemplify, can be modified as desired.

What is claimed is:

1. A printing apparatus comprising:

a transport unit configured to transport a printing medium;

a platen that includes a support surface supporting the printing medium;

a light-emitting unit configured to emit detection light toward a transport path of the printing medium; and a light-receiving unit provided adjacently to the light-emitting unit and configured to detect reflected light of the detection light, wherein a recessed portion is provided in the platen, the recessed portion including a primary reflection surface receiving the detection light and a secondary reflection surface receiving the detection light reflected by the primary reflection surface;

the support surface and the secondary reflection surface overlap in an optical axis direction of the detection light; and the secondary reflection surface is formed parallel to the primary reflection surface.

2. The printing apparatus according to claim 1, wherein the secondary reflection surface is a surface that diffuses and reflects incident light.

3. The printing apparatus according to claim 2, wherein the secondary reflection surface is a surface rougher than the primary reflection surface.

4. The printing apparatus according to claim 1, wherein the support surface is located upstream from the recessed portion in a transport direction of the printing medium;

the platen includes a downstream support surface located downstream from the recessed portion in the transport direction of the printing medium, the downstream support surface supporting the printing medium; and the primary reflection surface is a surface continuous with the downstream support surface, the primary reflection surface facing upstream in the transport direction of the printing medium.

5. The printing apparatus according to claim 1, comprising:

a carriage configured to perform reciprocating scanning in a scanning direction that intersects with the transport direction of the printing medium, and a print head mounted on the carriage, wherein the light-emitting unit and the light-receiving unit are mounted on the carriage; and the recessed portion extends along the scanning direction.

6. A printing apparatus comprising:

a transport unit configured to transport a printing medium;

a platen that includes a support surface supporting the printing medium;

a light-emitting unit configured to emit detection light toward a transport path of the printing medium; and a light-receiving unit provided adjacently to the light-emitting unit and configured to detect reflected light of the detection light, wherein a recessed portion is provided in the platen, the recessed portion including a primary reflection surface receiving the detection light and a secondary reflection surface receiving the detection light reflected by the primary reflection surface;

the support surface and the secondary reflection surface overlap in an optical axis direction of the detection light; and the secondary reflection surface is a surface rougher than the primary reflection surface.

7. The printing apparatus according to claim 6, wherein the secondary reflection surface is a surface that diffuses and reflects incident light.

8. The printing apparatus according to claim 6, wherein the support surface is located upstream from the recessed portion in a transport direction of the printing medium;

the platen includes a downstream support surface located downstream from the recessed portion in the transport direction of the printing medium, the downstream support surface supporting the printing medium; and the primary reflection surface is a surface continuous with the downstream support surface, the primary reflection surface facing upstream in the transport direction of the printing medium.

9. The printing apparatus according to claim 6, comprising:

a carriage configured to perform reciprocating scanning in a scanning direction that intersects with the transport direction of the printing medium, and a print head mounted on the carriage, wherein the light-emitting unit and the light-receiving unit are mounted on the carriage; and the recessed portion extends along the scanning direction.

* * * * *